US006013868A

United States Patent [19]

Sims et al.

[11] Patent Number: 6,013,868

[45] Date of Patent: Jan. 11, 2000

[54] CAPO DEVICE FOR STRINGED MUSICAL INSTRUMENT

[76] Inventors: Christopher George Sims; Jonathan Edward Sims, both of 94 Grove Road, Ottawa, Ontario, Canada, K1S 3A8

[21] Appl. No.: 09/134,529

[22] Filed: Aug. 14, 1998

[51] Int. Cl.[7] ..... G10D 3/00

[52] U.S. Cl. ..... 84/318

[58] Field of Search ..... 84/318

[56] References Cited

U.S. PATENT DOCUMENTS 4,503,747 3/1985 Labbé ..... 84/318

5,056,397 10/1991 Leifheit ..... 84/318

FOREIGN PATENT DOCUMENTS

4019358 A1 3/1991 Germany ..... 84/318

4224137 A1 1/1993 Germany ..... 84/318

*Primary Examiner*—Stanley J. Witkowski

[57] ABSTRACT

A capo device for a stringed musical instrument having a series of strings extending along a fretboard with spaced frets, in which each string passes through a bore in an element which is slidable on the string, each element being dimensioned so that when held against the fretboard the element stops the string on which it is mounted at the adjacent fret. The elements and the fretboard have interacting magnetic means capable of holding each element against the fretboard at one of a number of selected positions during the playing of the instrument, while allowing the element to be moved to a stored position when not in use. The stored position is usually between a string nut or zero fret, and a string guide which contacts the strings between the nut or zero fret and tuning pegs for the strings, the elements being movable over the nut or zero fret into the stored position.

11 Claims, 2 Drawing Sheets

CAPO DEVICE FOR STRINGED MUSICAL INSTRUMENT

BACKGROUND OF THE INVENTION

1. Field of the Invention

The present invention relates to a capo device for a stringed musical instrument having series of strings extending along a fretboard with a series of frets, i.e. an instrument such as a guitar, lute, banjo and the like. Such an instrument is played by plucking the strings while using fingers to stop selected strings by holding them pressed down onto the fretboard, the string being "stopped" by the adjacent fret.

2. Prior art.

A capo, sometimes referred to as a "capotasto" is a device which can be used to hold strings independently of the fingers. Simple capo devices hold all the strings at once, usually against a particular fret, and change the basic key of the instrument. Others are known which can be used to press down and stop only selected strings.

Generally, capo devices do not allow different strings to be stopped at different locations. However, in U.S. Pat. No. 5,056,397, which issued Oct. 15,1991 to Leifheit, a kind of capo device, referred to as a "fingering device" is described for a guitar, in which a series of separate capo type elements are provided each with a bore by which the element is slidably mounted on one of the strings and is individually locatable to stop a string at a particular selected location. Each element has an undercut recess in its underside and can be individually held in position by having this recess engage one of the frets, which are made to protrude from the fretboard. The elements of the Leifheit device stop the strings directly, rather than hold the string against an adjacent fret, as is more usual with capo devices.

A perceived drawback of the Leifheit device is that the elements, when not in use, are simply pushed to the end of the strings near to the string nut which terminates the vibrating portion of the strings near the head of the guitar. It seems likely that in this position the elements, although no longer attached to the fretboard, would still vibrate with and thus affect the vibration of the strings.

The present invention seeks to provide a capo type device which overcomes these drawbacks, and is also easier to use than the Leifheit device. The device of this invention is easy to engage and disengage with the fretboard, it stops the strings in the usual way by holding them against adjacent frets, which are conventional frets, and it provides a storage area for the elements when they are not in use where they cannot vibrate with the strings.

SUMMARY OF THE INVENTION

In accordance with one aspect of the present invention, a capo device for a stringed instrument of the type described, having a series of strings extending along a fretboard, is characterized by each string of the series passing through a bore in an element which is slidable on the string, with each element being dimensioned so that when held against the fretboard the element stops the string on which it is mounted at an adjacent fret. The elements and the fretboard have interacting magnetic means capable of holding each element against the fretboard at one of a number of selected positions during the playing of the instrument, while allowing movement of the elements to a stored position when not in use .

The magnetic means may include permanent magnets set into the fretboard at a series of locations adjacent individual fret, and/ or a permanent magnet mounted within each of the elements. In a preferred embodiment, however, all the magnets are in the fretboard, and these cooperate with capo elements of ferromagnetic material, such as steel.

A stored position for the elements may be provided beyond the ends of the vibrating portions of the strings, so that the stored elements cannot affect the vibration of the strings. Usually, the stored position will be defined either by a socalled "string nut" or by a "zero fret" which is a large fret terminating the vibrating portion of the strings. Both the "string nut" and the "zero fret" will be hereinafter referred to as an "end stop", since both define the end of the vibrating length of the strings, when not otherwise stopped. Thus, according to another aspect of the invention, a capo device is characterized by the combination of the slidable elements and fretboard with interacting means capable of holding the elements against the fretboard during the playing of t he instrument, while allowing movement of the elements over the frets to a stored position when not in use, along with a stored position defined between an end stop and an auxiliary string guide which contacts the strings between the end stop and the usual tuning pegs. The elements are movable over the end stop into the stored position. Where a string nut is used, a ramp member is preferably provided on the fret side of the string nut to facilitate movement of the elements over the nut and into the stored position.

As an alternative, the conventional string nut or zero fret may be dispensed with, and a series of storage recesses or pockets may be provided which locate the elements in stored positions in which they act to terminate the maximum vibrating length of the string. Unlike in Leifheit, the elements in this position are positively located and held against movement, and cannot vibrate with the string, so that the strings have a properly defined maximum length of vibration.

BRIEF DESCRIPTION OF THE DRAWINGS

Preferred embodiments of the invention will now be described by way of example with reference to the accompanying drawings, in which.

DETAILED DESCRIPTION

Figure 1:
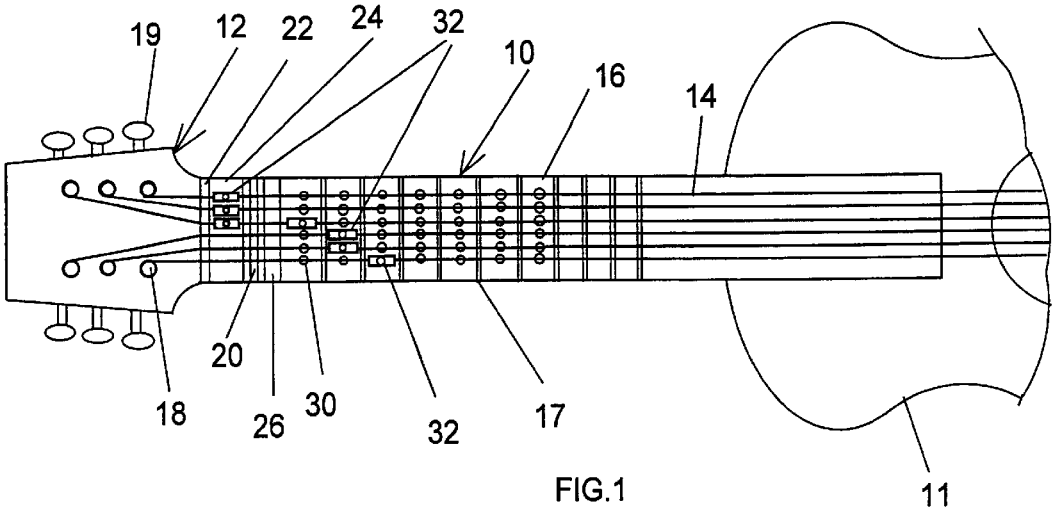
FIG. 1 is a top view of the fretboard portion of a guitar incorporating the invention.
Figure 2:
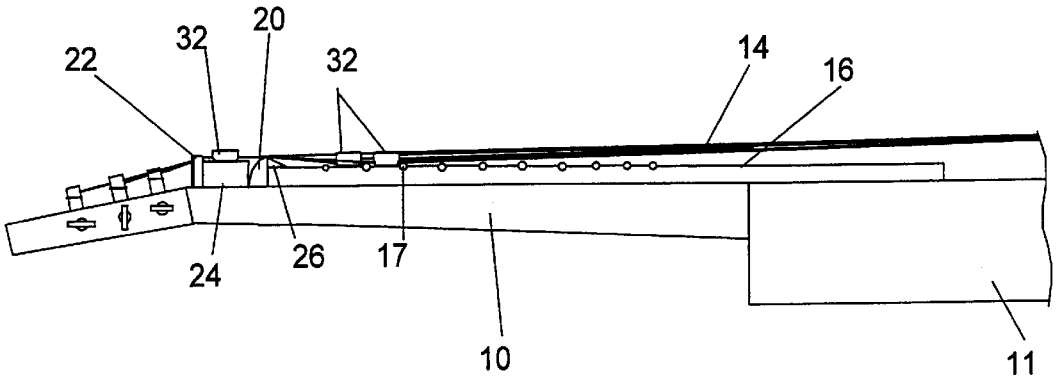
FIG. 2 is a side elevation of the same parts as shown in FIG. 1.

FIGS. 1 and 2 show the neck 10 of a guitar, this neck extending between the guitar body 11 and head 12. The body, and the parts mounted on the body, are conventional, and include a bridge (not shown) which anchors inner ends of the six strings 14. The strings extend along a fretboard 16 on the front face of the neck, having a parallel series of frets 17, and have their outer ends held by spindles 18 rotatable by tuning pegs 19, these parts also being conventional. The frets 17 are also generally conventional, having semi-cylindrical protruding portions which stand just over 1 mm above the planar surface of the fretboard.

As is also usual, the vibrating portions of the strings terminate at a "string nut" 20, and pass from the nut onto the spindles 18. Usually, the strings diverge after passing over the nut. Here, however, the strings remain parallel and substantially unbent until they pass over an upstanding auxiliary guide 22, after which they slope down towards the head and diverge towards the spindles. In the space between the nut 20 and the guide 22 is a platform 24, spaced a few millimeters below the strings. This platform has the same width as the neck and a length of about 1.5 cm; it provides a stored position for the capo elements to be described. On the fretboard side of the nut 20 a ramp member 26 provides a transition between the fretboard and the nut which facilitates movement of the elements into the stored position.

The fretboard 16 is modified, in accordance with the invention, by the provision of several rows of small cylindrical magnets 30, these magnets being each fitted into a cylindrical recess drilled into the fretboard and aligned with one of the overlying strings. The magnets are centered about 6 to 8 mm on the outerside (i.e. on the head side) of each of the frets 17. The magnets are so-called "rare earth" permanent magnets, specifically neodymium-iron-boron magnets, preferably of N-35 strength or greater; suitable magnets have a diameter of about ¼ inch (about 6 mm). Usually, the rows of magnets are provided at the outside of the outermost seven frets, but could be provided for more of the frets if desired.

Figure 3:
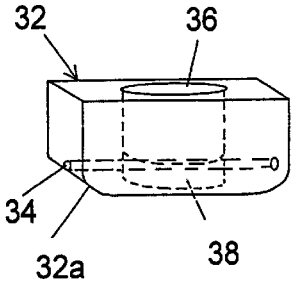
FIG. 3 is an enlarged, perspective view of one slidable capo element.
Figure 4:
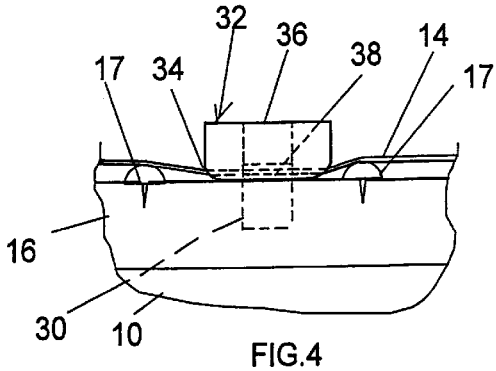
FIG. 4 is a side view of the same element and associated parts.

The magnets 30 cooperate with slidable capo elements 32, best shown in FIGS. 3 and 4. Each element is rectangular when seen is plan view; in side view (FIG. 4) it is generally rectangular but has rounded or bevelled lower corners 32*a* providing ramp means which enable it to move over the frets. The element has a length of about 11 mm, which is slightly less than the narrowest gap between adjacent frets, and has a width and height of about 7 mm. It is preferably formed of hard wood such as ebony, or plastic. The lower portion of the element has a longitudinal bore 34, laterally centered and spaced less than 1.0 mm from its lower surface, and which has a diameter, usually about 1/16 or 3/64 inch (1.2 to 1.5 mm), by which it has a snug but readily sliding fit on the respective string 14. Although it is not essential, the bore may have a bushing or liner of soft material to avoid any vibration of the element on the string.

The element 32 also has a wide cylindrical bore normal to and passing through the center of its top surface, which receives a magnet 36 which may be the same as, or similar to, one of the magnets 30 in the fretboard, and which has its lower end close to the bore 34. Between the bottom of the magnet and the bottom face of the element is a steel disc 38, through the lateral and axial center of which passes the bore 34. Use of the steel disc avoids the need to drill through the magnet 36, which requires special equipment.

The magnets 30 and 36 are of suitable strength that when an element 32 is located with its magnet aligned with a magnet 30 it is pulled into contact with the fretboard, in which position, as shown in FIG. 4, it holds the string on which it is mounted against the adjacent fret, effectively stopping this string in the same manner as a player's finger. The disc 38 completes the magnetic circuit between the two magnets. However, the magnetic force can easily be overcome by the player using a finger to push the element along the string when this is to be repositioned, the sloping corners 32*a* allowing the element to ride over the frets. This action is believed to be much easier than that involved in the Leifheit construction, and allows for easy rearrangement between songs. When the capo elements are not needed, they can be simply pushed to the end of the fretboard, with the ramp 26 allowing them to pass over the nut 20 into the stored position above the platform 24, where they cannot affect the vibration of the strings.

Figure 5:
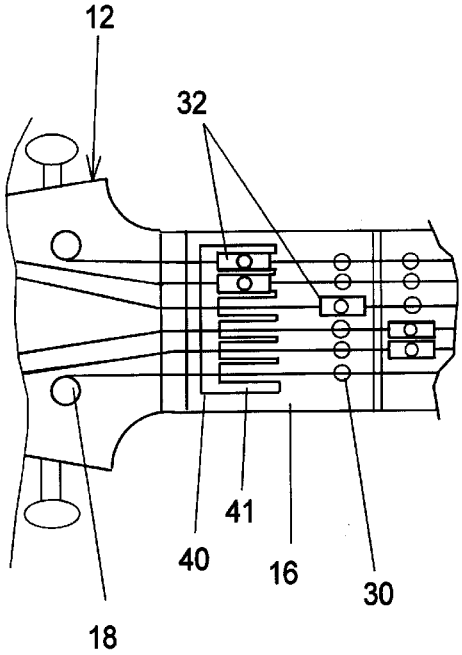
FIG. 5 is an enlarged top plan view of an alternative construction of the head end of the guitar.
Figure 7:
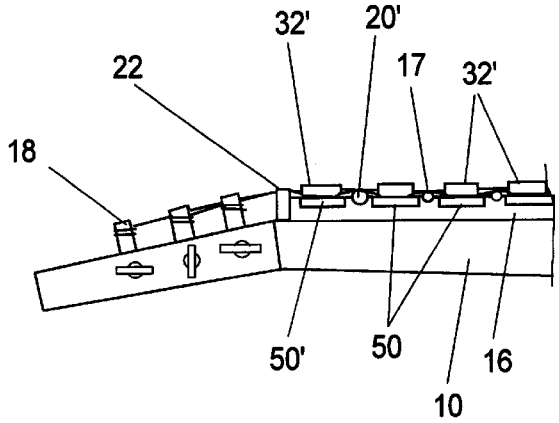
FIG. 7 is a side elevation of the same parts shown in FIG. 6.

FIG. 5 shows an alternative arrangement at the head of the guitar, in which the nut 20 and ramp 26 have been dispensed with, and instead a fitting 40 is provided having recesses or pockets 41 spaced across the fretboard at its head end, each recess underlying one string end and providing a storage position for one of the capo elements. Each recess 41 is made to fit its element precisely, so that the element in this position is firmly located and cannot vibrate, and its string is stopped at the end of the element, which is close to the normal string nut position. For precisely locating the elements, the recesses may be lined with shims of veneer.

FIGS. 6 to 9 show a preferred construction in which all the magnets 30' are in the fretboard, and the capo elements 32' are of ferromagnetic material, preferably steel, and have no magnets. This construction has the advantage that the capo elements do not tend to attract and stick to each other, as sometimes happens with the embodiments previously described. To give the required attractive force between the capo elements and the magnets, the magnets are provided in pairs, the magnets of each pair being aligned longitu dinally, i.e. along the string direction, and the magnets of each pair being closely spaced so that they can attract the same capo element.

Figure 6:
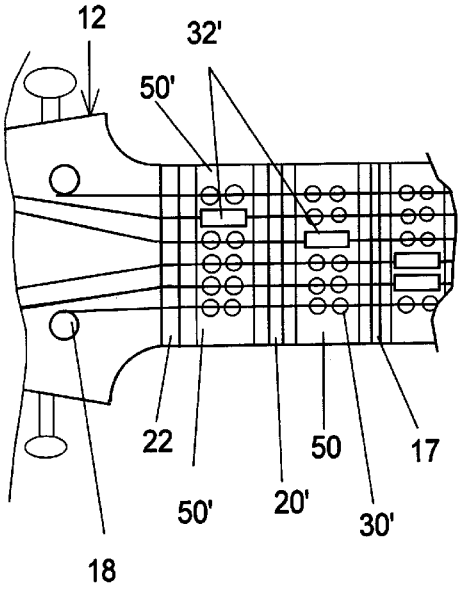
FIG. 6 is a view similar to FIG. 5 of another alternative, and preferred, form of the invention.
Figure 8:
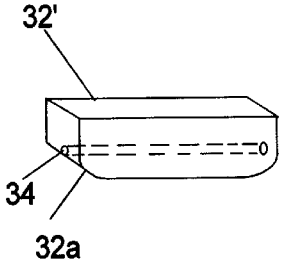
FIGS. 8 and 9 are views similar to Figs.3 and 4 of the preferred embodiment of FIGS. 6 and 7.
Figure 9:
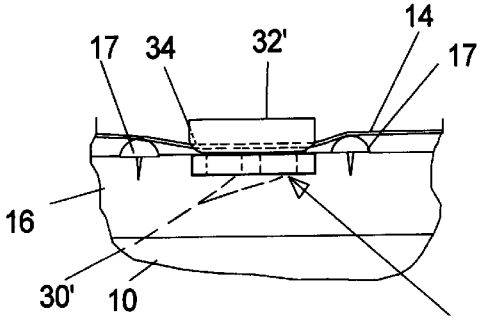

As show n in FIGS. 6 and 9, the pairs of magnets are preferably mounted on the fretboard by means of transverse mounting strips 50, each having a length equivalent to the fretboard width, a width of about 16 mm or ⅝ inch, and a thickness of about 3 to 4 mm. The strips are arranged to be glued in correspondingly sized mating grooves extending across the fretboard on the outer sides of the first seven or more frets. The strips may be of wood, and wood-type adhesives such epoxy glue may be used to secure these in place. Each strip has six pairs of magnets along its length, each located in relation to an overlying string, the magnets each having a diameter of about ¼ inch or 6 mm, and being closely spaced, separated by say about 2 mm. Each pair of magnets has one magnet with its sout h pole uppermost, and one with its north pole uppermost. The capo elements are simple slugs of steel, about 8 to 10 mm in length, i.e. having a length which at least spans the major part of the overall length of a magnet pair, and which completes a magnetic circuit wh en the element bridges the surfaces of a magnet pair. The height of the capo e lements is less than in the previous embodiment, and is typically about 4 mm. The elements have a horizontal bore for receiving a string, as in the previous embodiment, and preferably have a liner to prevent vibration on the string.

The rest position of the elements is in this case provided by an end series of pairs of magnets, held by a transverse strip 50' between the string guide 22, which is similar to that of FIGS. 1–4, and a "zero fret" 20' which acts as an end stop preventing vibration of the strings beyond this position and thus defines the end of the vibrating string length. The zero fret is of similar height to the nut 22, but since it is rounded, it does not require the ramp member used with the string nut of the first embodiment.

While the description above has concentrated on permanent magnets which are suitable for use with a conventional acoustic guitar, nevertheless with an electric guitar, electromagnets may be used, and the term "magnetic means" is of course broad enough to cover such electromagnets.

We claim:

1. A capo device for a stringed musical instrument having a series of strings extending along a fretboard with spaced frets, the device comprising:

a series of capo elements each having a bore, each said element being slidably mounted on one of said strings which passes through said bore in the element, each said element being dimensioned so that when held against the f retboard the element stops the string on which it is mounted at the adjacent fret, and wherein said elements and the fretboard have interacting magnetic means cap able of holding each elemen t against the fretboard at one of a number o f selected positions during the playing of the instrument, while allowing movement of the element to a stored position when not in use.

2. A capo device according to claim 1, wherein said magnetic means include permanent magnets set into the fretboard at a series of locations adjacent individual frets.

3. A capo device according to claim 1, wherein said magnetic means include a permanent magnet mounted within each of said capo elements.

4. A capo device according to claim 1, wherein said magnetic means are provided exclusively in said fretboard, and wherein said capo elements are formed of ferromagnetic material.

5. A capo device according to claim 4, wherein said magnetic means include pairs of magnets set into the fretboard at a series of locations between adjacent frets, each pair of magnets being aligned with and underlying a string, and being capable of interacting with a ferro-magnetic capo element to hold the element in place against the fretboard.

6. A capo device according to claim 5, wherein the capo element has a length at least equivalent to the major part of the length of one of said pairs of magnets.

7. A capo device according to claim 1, wherein said elements have undersides, adjacent the fretboard, with ramp means at the ends of the undersides facilitating movement of said elements over the frets.

8. A capo device according to claim 1, wherein said stored position is provided at the head end of the instrument beyond an end stop which terminates a vibrating portion of the strings.

9. A capo device according to claim 8, wherein said stored position is defined between said end stop and a string guide which contacts the strings between the end stop and tuning pegs for the strings, said elements being movable over said end stop into the stored position.

10. A capo device according to claim 1, wherein the instrument is a guitar, and each of the guitar strings carries one of said elements.

11. A capo device according to claim 1, wherein said stored position for each element is provided at the head end of the instrument by a recess which receives and locates the element in such manner that it cannot vibrate with its string.

* * * * *